US005649630A

United States Patent [19]

Remmler

[11] Patent Number: 5,649,630

[45] Date of Patent: Jul. 22, 1997

[54] MULTI-FUNCTIONAL DISH HOLDER

[75] Inventor: Geoffrey Remmler, Kinston, N.C.

[73] Assignee: White Consolidated Industries, Inc., Cleveland, Ohio

[21] Appl. No.: 396,923

[22] Filed: Mar. 1, 1995

[51] Int. Cl.[6] ..... A47G 19/08

[52] U.S. Cl. ..... 211/41.8; 211/181.1; 134/135

[58] Field of Search ..... 211/41, 71, 181; 134/570, 135

[56] References Cited

U.S. PATENT DOCUMENTS

| | | | |
|---|---|---|---|
| 4,183,437 | 1/1980 | Crawford et al. . | |
| 4,592,471 | 6/1986 | Bross | 211/41 |
| 4,606,464 | 8/1986 | Jordan et al. . | |
| 4,911,308 | 3/1990 | Nylund | 211/71 X |
| 4,917,248 | 4/1990 | Friskney | 211/41 |
| 5,109,990 | 5/1992 | Murphy et al. | 211/41 |
| 5,158,185 | 10/1992 | Michael et al. . | |
| 5,205,419 | 4/1993 | Purtilo | 211/41 |
| 5,344,029 | 9/1994 | Oghia et al. | 211/181 X |
| 5,351,837 | 10/1994 | Smith | 211/41 |
| 5,365,969 | 11/1994 | Edwards | 134/57 D |
| 5,480,035 | 1/1996 | Smith | 211/181 X |
| 5,497,890 | 3/1996 | Clark | 211/41 |

*Primary Examiner*—Leslie A. Braun
*Assistant Examiner*—Richard M. Smith
*Attorney, Agent, or Firm*—Pearne, Gordon, McCoy & Granger LLP

[57] ABSTRACT

A dish holder for holding a variety of different types of dishes having large and small diameters and large and small depths. The dish holder includes a pair of pivotable fences and a pair of pivot supports that pivotably support the fences along parallel spaced apart axes. Each of the fences has a horizontally disposed base wire and a plurality of V-shaped pins attached to and equally spaced along the base wire. The plurality of pins of one fence are longitudinally offset from the plurality of pins of the other fence such that each pin is generally equally longitudinally spaced from adjacent pins of the other fence. Each of the fences is pivotable between an open position wherein the pins are directed outwardly and upwardly and a closed position wherein the pins form an inverted-V.

17 Claims, 3 Drawing Sheets

MULTI-FUNCTIONAL DISH HOLDER

BACKGROUND OF THE INVENTION

1. Field of the Invention

The present invention generally relates to a dish holder and in particular to a dish holder having pivoting fences which form various configurations to support various types of dishes having large and small diameters and large and small depths.

2. Description of Related Art

Dish holders or racks such as those used in dishwashers should accommodate articles to be held in a manner which is efficient in its use of space in order to maximize the capacity of the dishwasher. The dish holders should also accommodate various types and sizes of articles from use to use. In some cases the dishwasher may be loaded with small diameter and small depth articles such as saucers. In other cases the dishwasher may be loaded with large diameter and/or large depth articles such as dinner plates, large bowls, or platters. In yet other cases the dishwasher may be loaded with small diameter and large depth articles such as small bowls. Additionally, the dishwasher may be loaded with drinking glasses or cups. Several dish holders have evolved to alleviate the problem of efficiently loading the variously shaped articles.

For example, U.S. Pat. No. 4,183,437, the disclosure of which is expressly incorporated herein in its entirety by reference, discloses a rack for a dishwasher. The rack includes a succession of aligned pairs of dish holding elements of alternate configuration. One element is an upwardly extending straight finger and the other element is diverging and substantially shorter than the finger. While the pivoted dividers may accommodate articles of varying depths, they do not accommodate articles of varying diameter.

U.S. Pat. No. 4,606,464, the disclosure of which is expressly incorporated herein in its entirety by reference, discloses a pivoted divider. The pivoted divider includes "dog-leg" shaped pins and is pivotable between upright and folded down positions. While the pivoted dividers may accommodate articles of varying diameters, they do not accommodate articles of varying depth.

U.S. Pat. No. 5,158,185, the disclosure of which is expressly incorporated herein in its entirety by reference, discloses a pair of pivoting dividers. Each divider includes two sets of pegs which are designed to hold first and second types of dishes. The pair of dividers pivot between first and second positions to selectively support the first and second types of dishes. While the pivotable dividers may accommodate articles of varying diameters, they do not accommodate articles of varying depth.

The cost of manufacture of any consumer item manufactured in great numbers, such as dishwashers, is of great significance and therefore any dish holder must be relatively simple and easily manufactured so as to minimize the costs involved. Accordingly, it is an object of the present invention to provide a dish holder that has a relatively low cost of manufacture, that provides increased load capacity of the dish washer, and accommodates dishes of various types having large and small diameters and large and small depths.

SUMMARY OF THE INVENTION

The dish holder of the present invention solves the above-noted problems by having a pair of pivoting fences which enable the dish holder to be formed into various configurations. The dish holder includes first and second fences and means for pivotably supporting the fences along parallel spaced apart axes. The first fence has a horizontally disposed first base wire and a first plurality of pins attached to and equally spaced along the first base wire. The second fence has a horizontally disposed second base wire parallel with and spaced apart from the first base wire and a second plurality of pins attached to and equally spaced along the second base wire. The second plurality of pins is longitudinally offset from the first plurality of pins such that each pin of the second plurality of pins is generally equally longitudinally spaced from adjacent pins of the first plurality of pins.

Each of the fences are pivotable between an open position and a closed position. A first configuration of the dish holder, having each of the fences in the closed position, provides relatively small longitudinal spacing for dishes between the interacting pins of the first and second fences. A second configuration, having both of the fences in the open position, provides relatively wide lateral support for dishes against the pins of both of the fences. A third configuration, having one of the fences in the closed position and one of the fences in the open position provides relatively large longitudinal spacing for the dishes between the pins of the fence in the closed position.

BRIEF DESCRIPTION OF THE DRAWINGS

The present invention will hereafter be described with reference to the drawing figures, wherein.

DETAILED DESCRIPTION OF THE PREFERRED EMBODIMENTS

Figure 1:
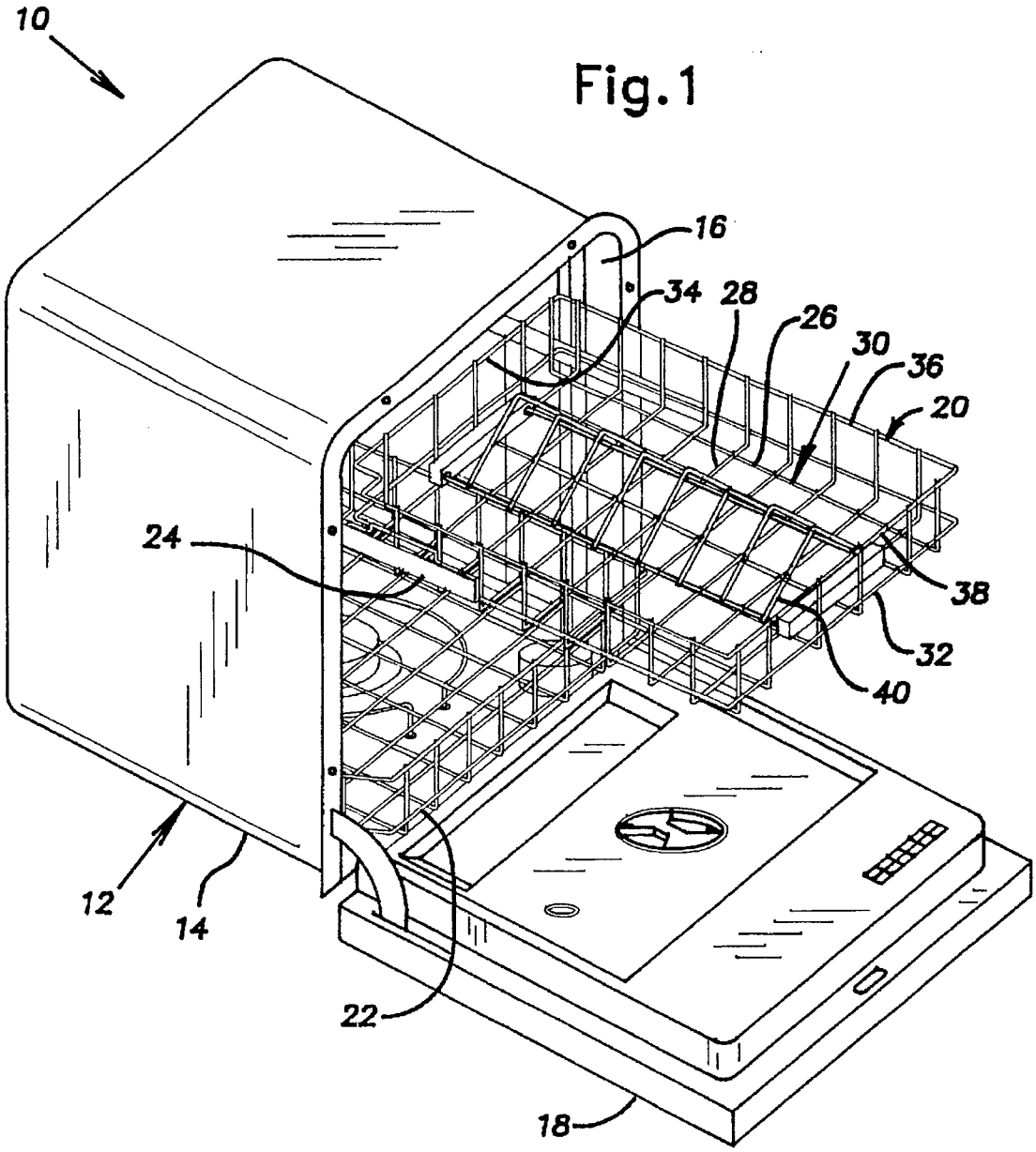
FIG. 1 is a perspective view of a dishwasher with a multi-functional dish holder according to the invention in an upper rack of a dishwasher.

A front loading automatic dishwasher 10, shown in FIG. 1, includes a tank 12 defining a cleaning chamber 14 having a front opening 16. A door 18 is hingedly mounted at the bottom of the front opening 16 for pivotal movement about a bottom edge, as is conventional. The door 18 moves from a vertical closed position (not shown) to a horizontal open position (shown in FIG. 1). Supported within the chamber 14 are upper and lower racks 20, 22 for supporting soiled articles or dishes to be cleaned by the dishwasher 10.

The lower rack 22 is supported within the chamber 14 by suitable tracks and is adapted to be rolled out onto the door 18 in its open position for loading and unloading. The upper rack 20 is supported within the chamber 14 by a pair of conventional telescopic tracks 24. The upper rack 20 is movable from a retracted position within the chamber 14 (not shown) and a fully extended position overlying the door 18 in its open position (shown in FIG. 1) for loading and unloading.

The racks 20, 22 are generally basket-shaped and are formed of segmental wire-frame construction wherein a plurality of horizontally disposed longitudinal and lateral wire segments 26, 28 are arranged in a criss-cross fashion to form a lattice-work bottom 30. Vertically disposed extensions of the wire segments 26, 28 form a front 32, a back 34, and sides 36. Horizontally disposed wire segments 38 extend around the outer periphery of the racks 20, 22 and cooperate with the vertically disposed extensions of the wire segments 26, 28 to define outer boundaries of the racks 20, 22. The wire segments 26, 28, 38 are sufficiently spaced to prevent stored dishes from passing therethrough while exposing the dishes to an upwardly projecting washing liquid for cleaning.

Mounted within the upper rack 20 is a multi-functional dish holder 40. FIG. 1 illustrates the dish holder 40 arranged from the front 32 to the back 34, or longitudinally, in the upper rack 20. The dish holder 40 could also be arranged from one side to the other side 36, or laterally, in the upper rack 20. The dish holder 40 could also be located in the lower rack 22. It will be noted that the dish holder 40 could also be utilized wherever it might be desirable for providing increased flexibility in loading various types or sizes of dishes such as, for example, a dish drainer.

Figure 2:
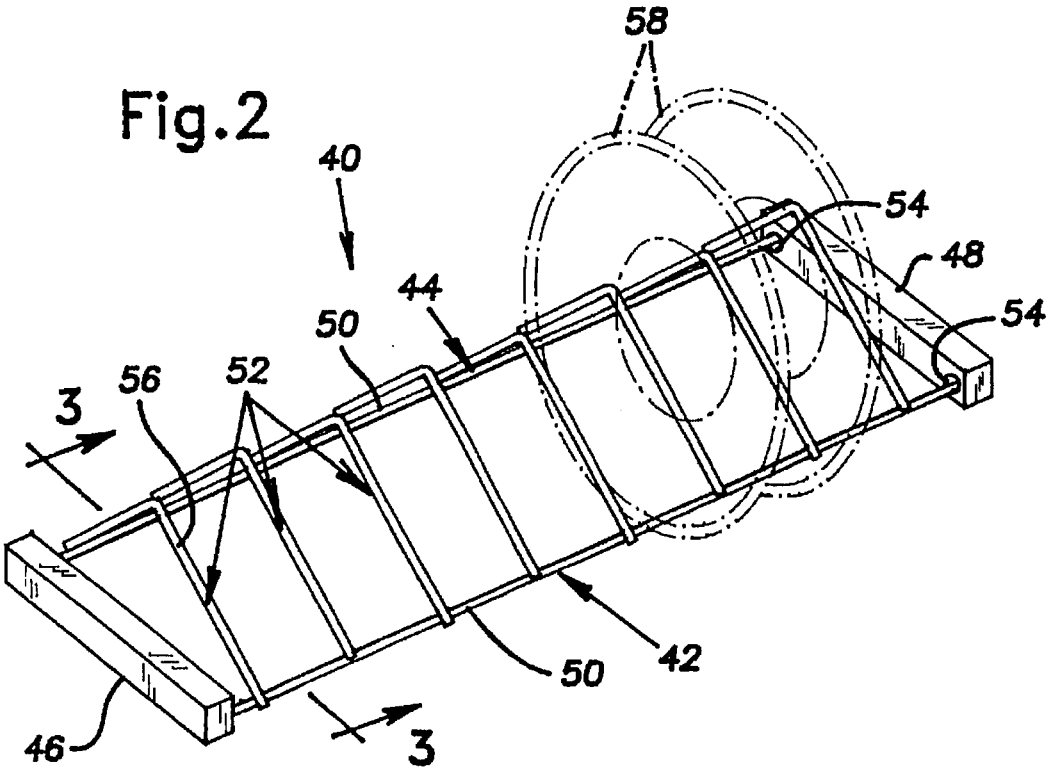
FIG. 2 is a perspective view of a multi-functional dish holder with both pivotable fences in a closed position.
Figure 3:
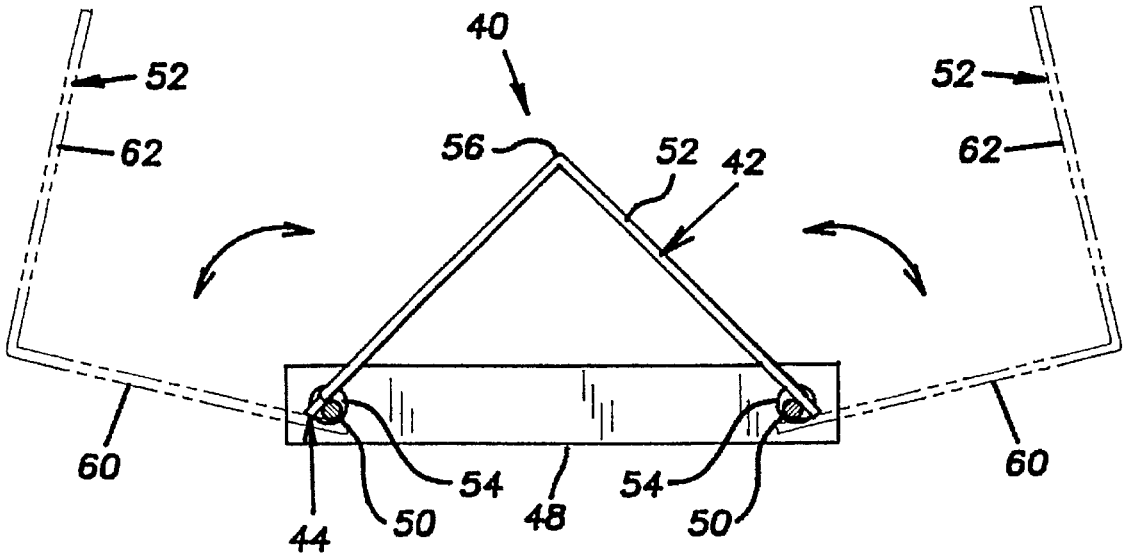
FIG. 3 is an elevational view, in cross-section, taken along line 3—3 of FIG. 2.
Figure 4:
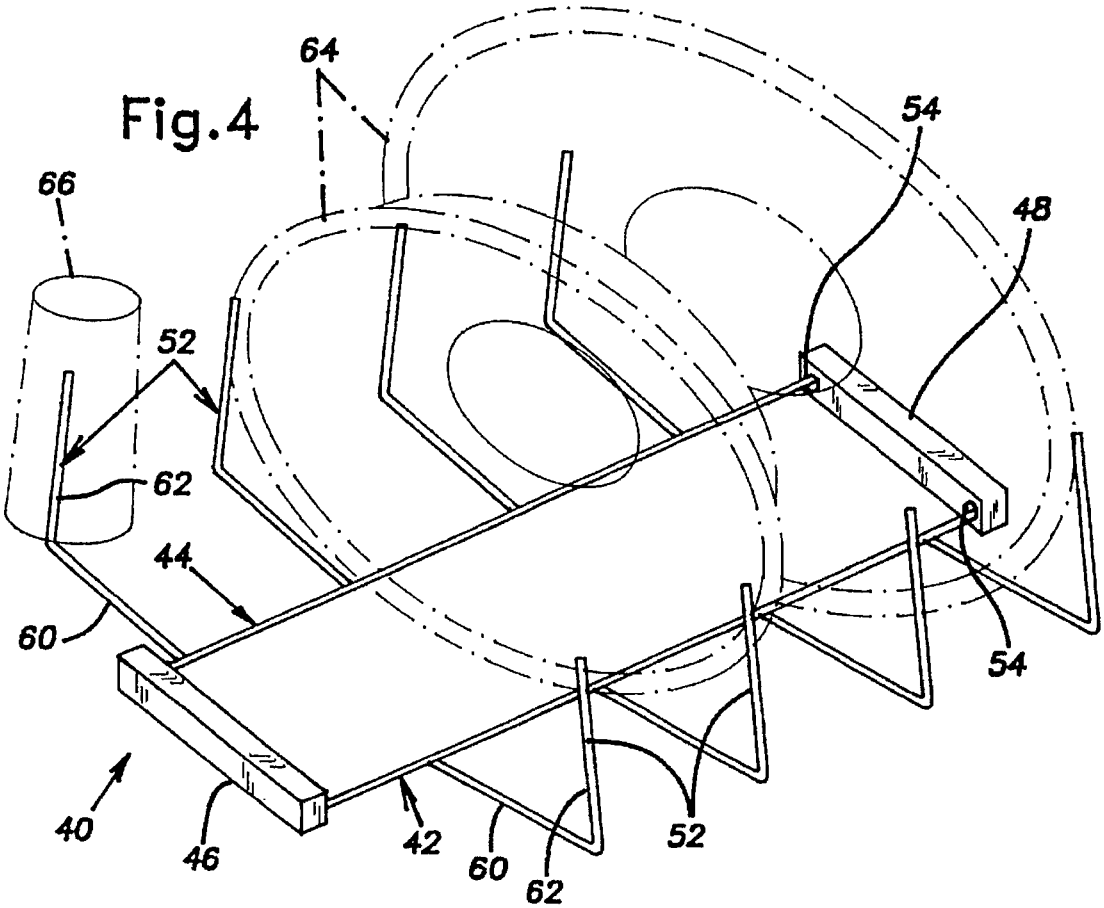
FIG. 4 is a perspective view of the multi-functional dish holder of FIG. 2 with both pivotable fences in an open position.

As best seen in FIGS. 2–4 the dish holder 40 includes first and second pivotable fences 42, 44 and means for pivotally supporting the pivotable fences. The means for pivotally supporting the fences of the illustrated embodiment are a pair of pivot supports 46, 48. It will be noted that the means for pivotally supporting the fences could take many forms such as, for example, a plurality of individual brackets as disclosed in U.S. Pat. No. 4,917,248, the disclosure of which is expressly incorporated herein in its entirety.

The fences 42, 44 are of segmental wire-frame construction. The segmental wire-frame construction and materials are preferably the type used for the upper and lower racks 20, 22 as known in the art. The fences 42, 44 are preferably formed from steel wire and coated with a PVC, nylon, vinyl or other plastic material to minimize rust of the steel wire and prevent scratching of the dishes. The coating material must have sufficient heat resistant qualities to withstand temperatures obtained in the dishwasher 10 which can reach approximately 140 degrees Fahrenheit. The fences 42, 44 may be formed from other materials, such as solid plastic or vinyl, as long as they have sufficient qualities relating to corrosion resistance, heat resistance, strength, weight, and rigidity.

Figure 5:
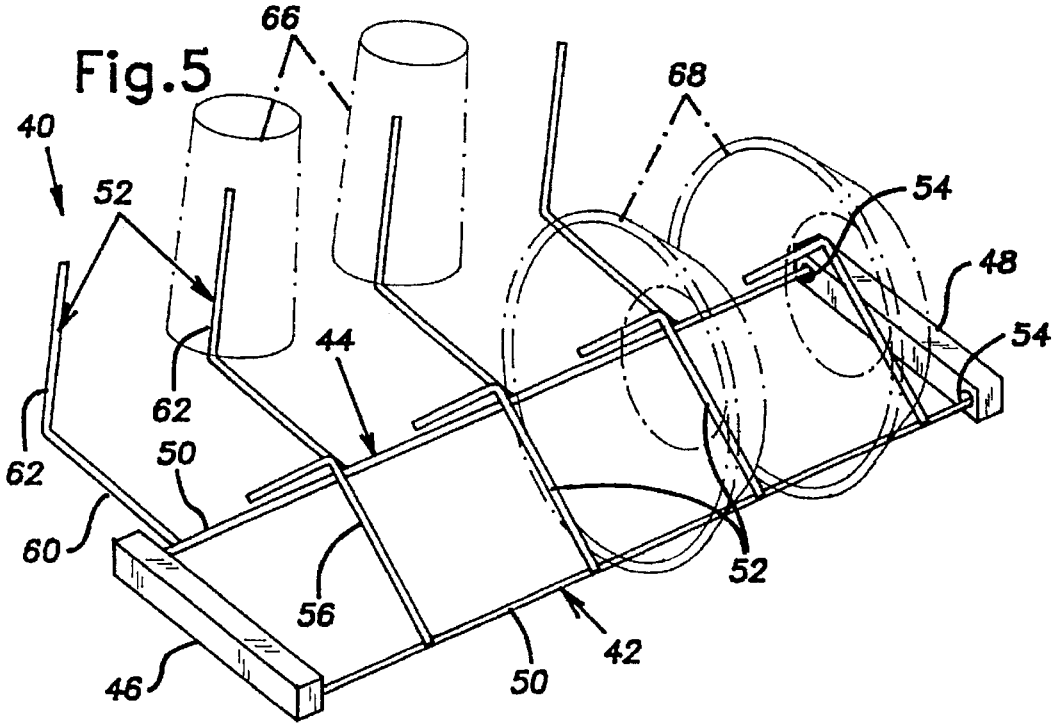
FIG. 5 is a perspective view of the multi-functional dish holder of FIG. 2 with one fence in an open position and the other fence in a closed position.

As best seen in FIGS. 4 and 5, each of the fences 42, 44 include a longitudinal wire segment or base wire 50 and a plurality of lateral wire segments or pins 52. Each fence 42, 44 of the illustrated embodiment has a group of four pins 52. It will be noted that other quantities of pins 52 could be attached to each fence 42, 44. Each pin 52 is perpendicularly attached to the base wire 50 and is equally spaced relative to the other pins 52 on the base wire 50 in a "comb" like manner. In the illustrated embodiment, therefore, the four pins 52 form three equally sized spaces. As best seen in FIG. 5, the pins 52 are preferably spaced a length effective for supporting a small bowl. As best seen in FIG. 4, the group of pins 52 is offset or unequally spaced relative to the ends of the base wire 50. The group of pins 52 is preferably offset towards one end of the base wire 50 a distance generally equal to ¼ the length of one of the spaces between the pins 52. This offset allows the pins 52 of one fence to be offset relative to the pins 52 of the other fence, as further described below, while allowing the fences 42, 44 to have identical configurations.

As best seen in FIG. 3, the pins 52 are generally V-shaped. It is noted however that this is representative of a particular embodiment and other variations are possible for achieving the flexibility of loading various types or sizes of dishes.

Each pivot support 46, 48 includes a pair of apertures 54 for pivotally retaining an end of each of the base wires 50. The apertures 54 are spaced to position the base wires 50 a lateral distance apart that is effective for supporting a saucer as shown in FIG. 2 or a bowl as shown in FIG. 5. Preferably, the base wires 50 are spaced a distance equal to a distance that the wire segments 26, 28 of the racks 22, 24 are typically spaced. The pivot supports 46, 48 can include means for positively mounting or attaching the dish holder 40 to the longitudinal wire segments 26, 28 of the racks 20, 22. For example, each of the pivot supports could have two pairs of flexible fingers that form apertures wherein the wire segments are inserted into the apertures by flexing apart the fingers.

The pair of fences 42, 44 are retained between the pair of pivot supports 46, 48 such that they each can pivot or rotate on the longitudinal axis of their respective base wires 50. Each of the fences 42, 44 can inwardly rotate to a closed position. In the closed position, the pins 52 have a centrally located, that is located generally between the two base wires 50, and upwardly extending portion 56 which provides relatively narrow lateral support for the dishes as best seen in FIG. 3. Preferably, the pins 52 have a centrally located bend. The pins of the illustrated embodiment, having a V-shape, form an inverted-V in the closed position as shown in FIG. 3.

FIG. 2 illustrates a first or fully closed configuration of the dish holder 40 wherein each of the fences 42, 44 are in the closed position. As best seen in FIG. 3, further inward rotation of each fence 42, 44 is prevented by interference between the pins 52 of that fence and the base wire 52 of the other fence. In the fully closed configuration of FIG. 2, the pins 52 of each fence 42, 44 are equally spaced between adjacent pins of the other fence due to the offset described above. In the illustrated embodiment, therefore, the eight pins 52 interact to form seven equally sized spaces that have a length equal to approximately ½ the length of each of the three spaces formed by the four pins 52 of a single base wire 50. The relatively small length of the spaces advantageously holds small plates, saucers, or other dishes 58 that require a relatively small longitudinal spacing and/or relatively narrow lateral support.

As best seen in FIG. 3, each of the fences 42, 44 can outwardly rotate from the closed position (shown in solid lines) to an open position (shown in phantom lines). In the open position, the pins 52 have an outwardly extending portion 60 and an upwardly extending portion 62. The outwardly extending portions 60 separate the upwardly extending portions 62 a distance adequate to provide relatively wide lateral support for dishes between the two upwardly extending portions 62 as shown in FIG. 3.

FIG. 4 illustrates a second or fully open configuration of the dish holder 40 wherein each of the fences 42, 44 is in the open position. The relatively wide lateral distance between the upwardly extending portions 62 of the pins 52 and the relatively large length of the central space advantageously supports plates, platters, large bowls, or other dishes 64 that require relatively large longitudinal spacing and/or relatively wide lateral support. The upwardly extending portions 62 of the pins 52 in the open position can also advantageously support glasses or cups 66.

FIG. 5 illustrates a third or partially open and partially closed configuration of the dish holder 40 wherein one fence 44 is in the open position and the other fence 42 is in the closed position. The relatively large length of the spaces between the pins 52 of the fence 42 in the closed position advantageously holds small bowls, or other dishes 68 that require relatively large longitudinal spacing and/or relatively narrow lateral support. The upwardly extending portions 62 of the pins on the fence 44 in the open position can also advantageously support glasses or cups.

Although particular embodiments of the dish holder have been described in detail, it will be understood that the invention is not limited correspondingly in scope, but includes all changes and modifications coming within the spirit and terms of the claims appended hereto.

What is claimed is:

1. A dish holder for holding a variety of different types of dishes, said dish holder comprising:

a first fence having a horizontally disposed first base wire and a first plurality of V-shaped pins attached to and spaced along said first base wire;

a second fence having a horizontally disposed second base wire parallel with and spaced apart from said first base wire and a second plurality of V-shaped pins attached to and spaced along said second base wire;

means for pivotably supporting said fences along parallel spaced apart longitudinal axes, each of said fences being pivotable between an open position and a closed position; and wherein each of said pins of said first fence and each of said pins of said second fence have an upwardly extending portion disposed outwardly of said first and second base wires when in an open position and an upwardly extending portion disposed centrally between said first and second base wires when in a closed position.

2. The dish holder according to claim 1, wherein said second plurality of pins are longitudinally offset from said first plurality of pins a distance generally equal to about one half the distance between adjacent pins of said first plurality of pins such that each pin of said second plurality of pins is located generally midway between adjacent pins of said first plurality of pins.

3. The dish holder according to claim 2, wherein said first plurality of pins is offset relative to ends of said first base wire.

4. A dish holder for holding a variety of different types of dishes, said dish holder comprising:

a first fence having a horizontally disposed first base wire and a first plurality of V-shaped pins attached to and spaced along said first base wire;

a second fence having a horizontally disposed second base wire parallel with and spaced apart from said first base wire and a second plurality of V-shaped pins attached to and spaced along said second base wire;

means for pivotably supporting said fences along parallel spaced apart longitudinal axes so that each of said first and second fences is pivotable between at least two positions, each pin of said first and second plurality of V-shaped pins having an upwardly extending portion disposed centrally between said first and second base wires when in a closed position; and wherein said second plurality of pins is longitudinally offset from said first plurality of pins a distance generally equal to about one half the distance between adjacent pins of said first plurality of pins such that each pin of said second plurality of pins is located generally midway between adjacent pins of said first plurality of pins.

5. The dish holder according to claim 4, wherein each of said pins of said first fence and each of said pins of said second fence have an upwardly extending portion disposed outwardly of said first and second base wires when in an open position and an upwardly extending portion disposed generally between said first and second base wires when in a closed position.

6. The dish holder according to claim 5, wherein each of said pins of said first fence and each of said pins of said second fence have a generally centrally located bend.

7. The dish holder according to claim 4, wherein said V-shaped pins are inverted when said fences are in said closed position.

8. The dish holder according to claim 4, wherein said first plurality of pins is offset relative to ends of said first base wire.

9. The dish holder according to claim 3, wherein said first plurality of pins is offset from one end a distance generally equal to ¼ the distance between adjacent pins of said first plurality of pins.

10. The dish holder according to claim 4, wherein said first plurality of pins are equally spaced along said first base wire and said second plurality of pins are equally spaced along said second base wire.

11. The dish holder according to claim 4, wherein said first base wire is coaxial with a first one of said parallel spaced apart longitudinal axes and said second base wire is coaxial with a second one of said parallel spaced apart longitudinal axes.

12. The dish holder according to claim 4, wherein said first and second fences mesh when in a closed position.

13. A dishwasher rack assembly for holding a variety of different types of dishes, said dishwasher rack assembly comprising:

a rack having a bottom including a plurality of spaced apart longitudinal and lateral wire segments;

a first fence having a horizontally disposed first base wire and a first plurality of V-shaped pins attached to and spaced along said first base wire;

a second fence having a horizontally disposed second base wire parallel with and spaced apart from said first base wire and a second plurality of V-shaped pins attached to and spaced along said second base wire, said second plurality of pins being longitudinally offset from said first plurality of pins a distance generally equal to about one half the distance between adjacent pins of said first plurality of pins such that each pin of said second plurality of pins is located generally midway between adjacent pins of said first plurality of pins; and means for pivotably mounting said fences on said bottom of said rack along parallel spaced apart longitudinal axes so that each of said first and second fences is pivotable between at least two positions, each pin of said first and second plurality of V-shaped pins having an upwardly extending portion disposed centrally between said first and second base wires when in a closed position.

14. The dishwasher rack assembly according to claim 13, wherein each of said pins of said first fence and each of said pins of said second fence have an outwardly located upright portion in an open position and a centrally located upright portion in a closed position for providing narrow lateral support in said closed position relative to said open position.

15. The dishwasher rack assembly according to claim 13, wherein said V-shaped pins are inverted when said fences are in said closed position.

16. The dishwasher rack assembly according to claim 13, wherein said first plurality of pins is offset relative to ends of said first base wire.

17. A dishwasher for washing dishes of a variety of different types, said dishwasher comprising:

a tub having a front opening;

a door capable of sealably closing said front opening of said tub;

a sprayer capable of spraying water within said tub;

at least one rack within said tub and having a bottom including a plurality of spaced apart longitudinal and lateral wire segments;

a first fence having a horizontally disposed first base wire and a first plurality of V-shaped pins attached to and spaced along said first base wire;

a second fence having a horizontally disposed second base wire parallel with and spaced apart from said first base wire and a second plurality of V-shaped pins attached to and spaced along said second base wire, said second plurality of pins being longitudinally offset from said first plurality of pins a distance generally equal to about one half the distance between adjacent pins of said first plurality of pins such that each pin of said second plurality of pins is located generally midway between adjacent pins of said first plurality of pins; and means for pivotably mounting said fences on said bottom of said rack along parallel spaced apart longitudinal axes so that each of said first and second fences is pivotable between at least two positions, each pin of said first and second plurality of V-shaped pins having an upwardly extending portion disposed centrally between said first and second base wires when in a closed position.

* * * * *

UNITED STATES PATENT AND TRADEMARK OFFICE

CERTIFICATE OF CORRECTION

PATENT NO. : 5,649,630

DATED : July 22, 1997

INVENTOR(S) : Geoffrey Remmler

It is certified that error appears in the above-indentified patent and that said Letters Patent is hereby corrected as shown below:

Column 6, line 17, "3" should be --8--.

Signed and Sealed this

Second Day of December, 1997

*Attest:*

Bruce Lehman

BRUCE LEHMAN

*Attesting Officer*

*Commissioner of Patents and Trademarks*